US005649698A

United States Patent [19]

Auerbach et al.

[11] Patent Number: 5,649,698

[45] Date of Patent: *Jul. 22, 1997

[54] METHOD AND APPARATUS FOR TURNING OVER AND MERGING SLIT DOCUMENTS

[75] Inventors: David R. Auerbach, West Redding; William J. Wright, Killingworth, both of Conn.

[73] Assignee: Pitney Bowes Inc., Stamford, Conn.

[ * ] Notice: The term of this patent shall not extend beyond the expiration date of Pat. No. 5,538,240.

[21] Appl. No.: 334,660

[22] Filed: Nov. 4, 1994

[51] Int. Cl.[6] ..... B65H 5/00; B65H 29/00

[52] U.S. Cl. ..... 271/225; 271/274; 271/186; 271/198

[58] Field of Search ..... 271/184, 185, 271/186, 188, 216, 225, 275, 279, 272–274, 198

[56] References Cited

U.S. PATENT DOCUMENTS

| | | | |
|---|---|---|---|
| 3,334,723 | 8/1967 | Reed et al. | 198/31 |
| 4,019,435 | 4/1977 | Davis | 101/232 |
| 4,527,792 | 7/1985 | Barldardt | 271/225 |
| 4,572,350 | 2/1986 | Bereneau | 198/365 |
| 4,674,375 | 6/1987 | Golicz | 83/91 |
| 4,785,165 | 11/1988 | Kruk | 235/375 |
| 4,844,442 | 7/1989 | Gammerler | 271/225 |
| 4,879,571 | 11/1989 | Plasscheart | 271/225 X |
| 4,943,369 | 7/1990 | Gombault | 209/583 |
| 5,180,154 | 1/1993 | Malick | 271/2 |
| 5,180,159 | 1/1993 | Malick | 271/302 |
| 5,188,355 | 2/1993 | Lowell et al. | 271/225 |
| 5,282,528 | 2/1994 | Hudson | 198/604 |
| 5,318,285 | 6/1994 | Edwards et al. | 271/225 |
| 5,333,851 | 8/1994 | Kulpa | 271/225 |
| 5,362,039 | 11/1994 | Kusters | 271/225 |
| 5,439,208 | 8/1995 | Mojer et al. | 271/225 |

FOREIGN PATENT DOCUMENTS

| | | | |
|---|---|---|---|
| 872632 | 6/1971 | Canada | 198/27 |
| 578614 | 1/1994 | European Pat. Off. | 271/225 |
| 57759 | 5/1979 | Japan | 271/225 |
| 170336 | 10/1982 | Japan | 271/186 |
| 152845 | 1/1990 | Japan | 271/186 |
| 41359 | 2/1992 | Japan | 171/225 |

*Primary Examiner*—Boris Milef

*Attorney, Agent, or Firm*—Charles R. Malandra, Jr.; Melvin J. Scolnick

[57] ABSTRACT

Apparatus for receiving multiple first documents cut from a single sheet that are being fed side by side in a first direction and individually guiding and controlling the first documents through a right angle turn includes a plurality of right angle turn over modules. Each of such modules includes a lower plate having input structure at one end for receiving the first documents conveyed thereto in a first direction and an upper plate mounted a fixed distance above the lower plate. The upper plate includes a turn over section adjacent to a downstream end of the input structure and angled at 45° to the first direction. The upper plate also includes a plurality of output rollers rotatably mounted in the top of the upper plate and oriented for moving the first documents at a direction orthogonal to the first direction. A turning guide that is positioned adjacent the turn over section, includes a curved edge that extends a fixed distance from the turn over section for guiding the first documents around the turn over section. A belt assembly is positioned above the upper plate and oriented for conveying the first documents in a direction orthogonal to the first direction. A deflector is located between the input structure of adjacent right angle turn over modules for deflecting one of the first documents whereby the one of the first documents avoids being conveyed into any part of the right angle turn over device into which an adjacent first document is being fed.

19 Claims, 12 Drawing Sheets

FIG. 2
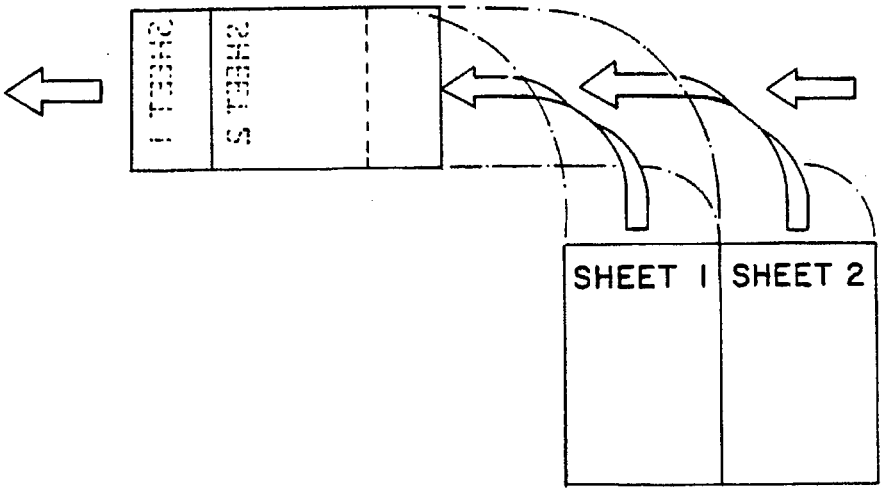
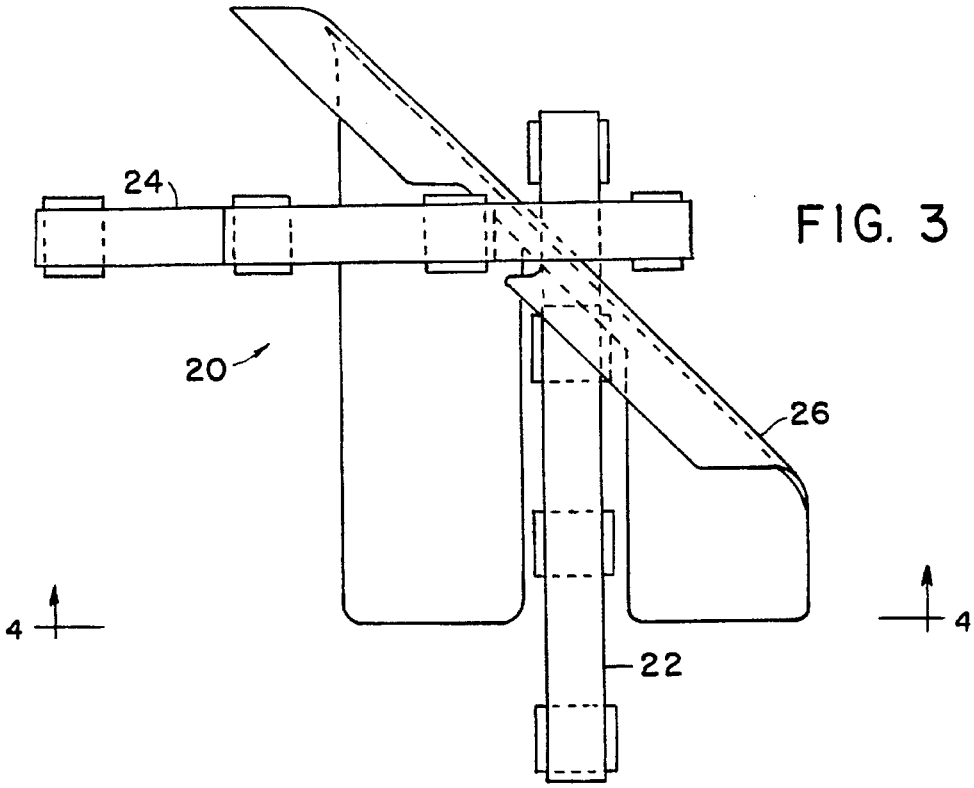
FIG. 3
FIG. 4
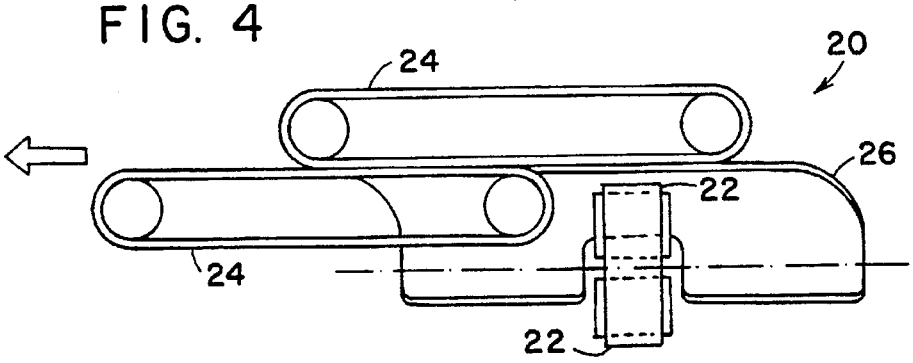

FIG. 9
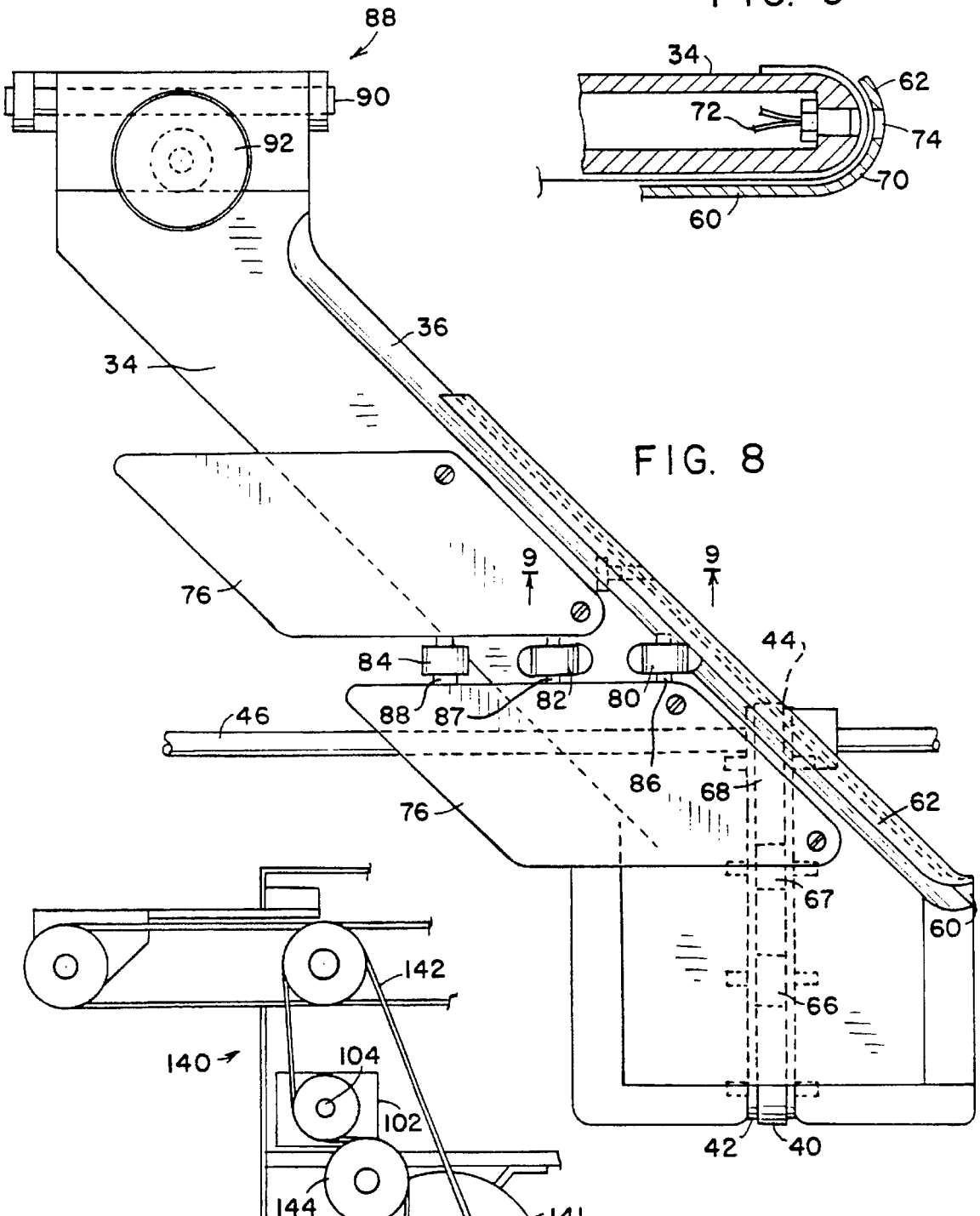
FIG. 8
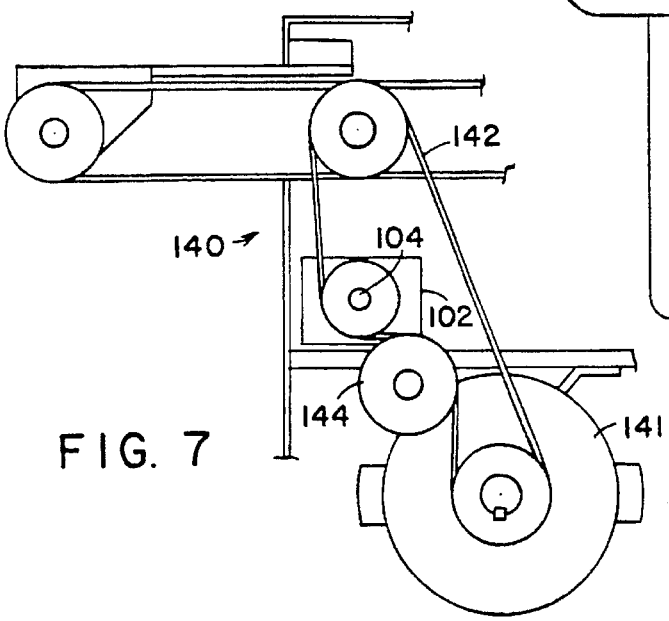
FIG. 7

FIG. 16
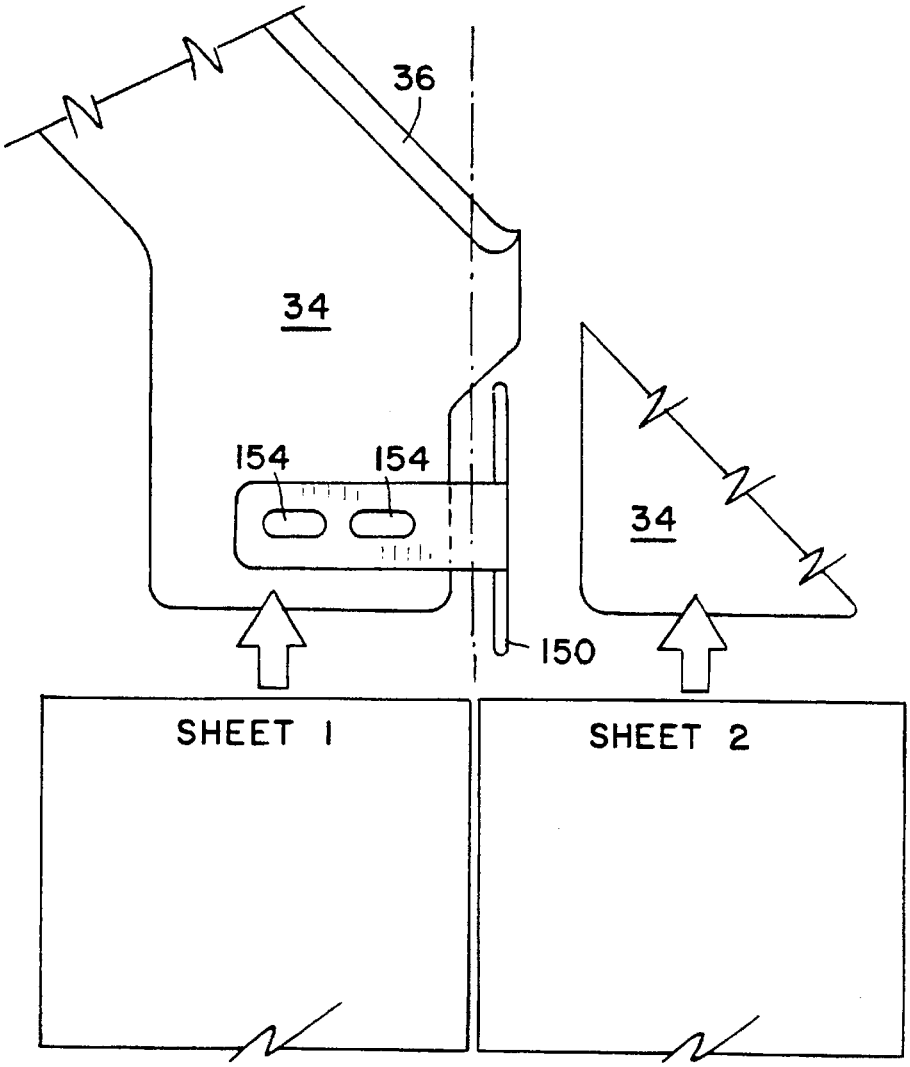
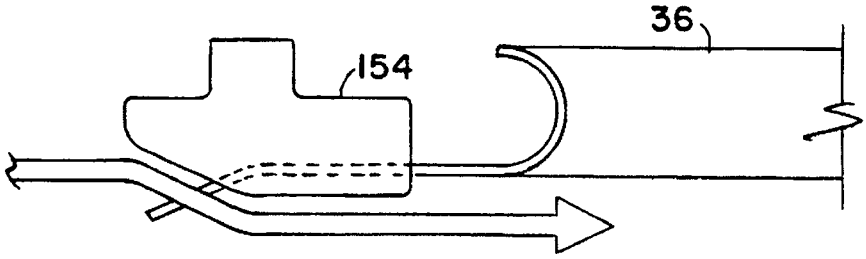
FIG. 17

METHOD AND APPARATUS FOR TURNING OVER AND MERGING SLIT DOCUMENTS

FIELD OF THE INVENTION

The present invention relates generally to apparatus and method for changing the conveying direction of individual documents and, more particularly, to such apparatus and method that turns over the documents as well as changing the conveying direction.

RELATED APPLICATIONS

The present application is related to U.S. application Ser. No. 08/334,654 and 08/334,833, filed concurrently herewith, and assigned to the assignee of the present invention the latter of which has issued as U.S. Pat. No. 5,538,240.

BACKGROUND OF THE INVENTION

Document turn over devices are well known. For example, in U.S. Pat. Nos. 5,333,851 and 4,844,442 different ninety degree turning belt transport apparatus and methods are disclosed, each including include a stationary cylinder around which a plurality of upper and lower transport belts move to convey documents about the stationary cylinder. The transport belts are trained over a plurality of rollers that are positioned and angled such that the belts turn over the document while conveying the document from an input path to an output path that is ninety degrees from the direction of the input path. One of the disadvantages in such an arrangement is that it would be difficult to add a second input that is in line with the output path. Another disadvantage is that the belts moving around the stationary cylinder typically produce static electricity that can effect the processing of documents passing thereby. Further, the initial set up and maintenance of such devices is cumbersome because of the plurality of belts and the angle of their corresponding rollers that are needed to transport the document around the cylinder. In each case, the belts, or some portion thereof maintain control of the document around the cylinder. However, since the belts are compliant, the documents have a tendency to skew or move such that the center line of the document will not necessarily as needed for further processing. Thus, further alignment apparatus would be necessary downstream of such transports before further processing could continue. U.S. Pat. No. 4,019,435 discloses a sheet inverting device that includes a registration feature but does not change the direction of the sheets.

Right angle transports are also well known. For example, U.S. Pat. Nos. 5,180,154, 5,180,159 and 4,527,792 show various apparatus and methods for transporting documents in a right angle change of direction. And, U.S. patent application Ser. No. 08/173,040, filed Dec. 27, 1993, discloses a right angle transport that further includes means for handling a second in-line input.

The aforementioned apparatus are comprised of several moving parts that must be assembled and maintained. Furthermore, such apparatus are not suitable for being configured for handling multiple documents that are conveyed side by side such as two-up or three-up documents that have been slit from a single sheet.

It is well known to print multiple documents on a large sheet of paper and then separate the large sheet into smaller separate documents which can be merged for further processing. Such a technique is commonly referred to as "slit and merge". Generally, after the slit is made to the large sheet the slit documents must be separated to prevent them from interfering with each other as they are merged. For example, in U.S. Pat. No. 4,785,165 the slit documents are separated in collector means before further processing. In U.S. Pat. No. 4,674,375 the slit documents are deposited on a plurality of superimposed guide plates to separate the documents before further processing. Generally, such slit and merge devices perform the slit and merge function is the one direction and do not include the turning over of the documents as part of the merging function.

SUMMARY OF THE INVENTION

The present invention provides apparatus for receiving multiple first documents cut from a single sheet that are being fed side by side in a first direction and individually guiding and controlling the first documents through a right angle turn includes a plurality of right angle turn over modules. Each of such modules includes a lower plate having input structure at one end for receiving the first documents conveyed thereto in a first direction and an upper plate mounted a fixed distance above the lower plate. The upper plate includes a turn over section adjacent to a downstream end of the input structure and angled at 45° to the first direction. The upper plate further includes structure superposed over the input structure for cooperating with the input structure for transporting the first documents through the turn over section. The upper plate also includes a plurality of output rollers rotatably mounted in the top of the upper plate and oriented for moving the first documents at a direction orthogonal to the first direction. A turning guide that is positioned adjacent the turn over section, includes a curved edge that extends a fixed distance from the turn over section for guiding the first documents around the turn over section. A belt assembly is positioned above the upper plate and oriented for conveying the first documents in a direction orthogonal to the first direction. The belt assembly includes an endless upper belt moving around at least two rollers and further includes structure for applying a normal force to the lower reach of the upper belt directly above each of the output rollers whereby the upper belt and the output rollers cooperate to convey the first documents out of the turn over section of the upper plate. A deflector is located between the input structure of adjacent ones of the right angle turn over modules for deflecting one of the first documents whereby the one of the first documents avoids being conveyed into any part of the right angle turn over device into which an adjacent first document is being fed. The belt assembly includes structure for receiving second documents being conveyed seriatim along the second deck level in the second direction and transporting the second documents in the second direction. The output structure has an input end on the second deck level separate from the turn over chute.

The present invention provides jam sensing and total jam clearing accessibility along with the adjustability for different size forms.

DESCRIPTION OF THE DRAWINGS

The above and other objects and advantages of the present invention will be apparent upon consideration of the following detailed description, taken in conjunction with accompanying drawings, in which like reference characters refer to like parts throughout, and in which:

FIG. 2 is a top view of side by side sheets being turned over at a right angle in accordance with the present invention;

FIG. 3 is a top view of one embodiment of the present invention with upper and lower input and output belts and turning guide plate of the present invention;

FIG. 4 is a side view of the input and output belts and turning guide plate seen in FIG. 3 along line 4—4.;

FIG. 7 is a side view of the serpentine drive of the right angle turn-over device seen in FIG. 4;

FIG. 8 is a top view of a right angle turn-over module of the right angle turn-over device seen in FIG. 4;

FIG. 9 is side view of the right angle turn-over module seen in FIG. 8 along line 9—9;

FIG. 16 is an expanded top view of the deflector plate on the right angle turning module;

FIG. 17 is a side view of the deflector plate seen in FIG. 18.

DETAILED DESCRIPTION OF THE PRESENT INVENTION

In describing the present invention, reference is made to the drawings, wherein there is seen a right angle turn-over device 10, referred to herein as RAT 10, that receives documents being conveyed seriatim in a first direction, turns them over and rotates them 90° to align them with a document path in a second direction that is orthogonal to the first direction, and merges the documents for further processing.

Figure 1:
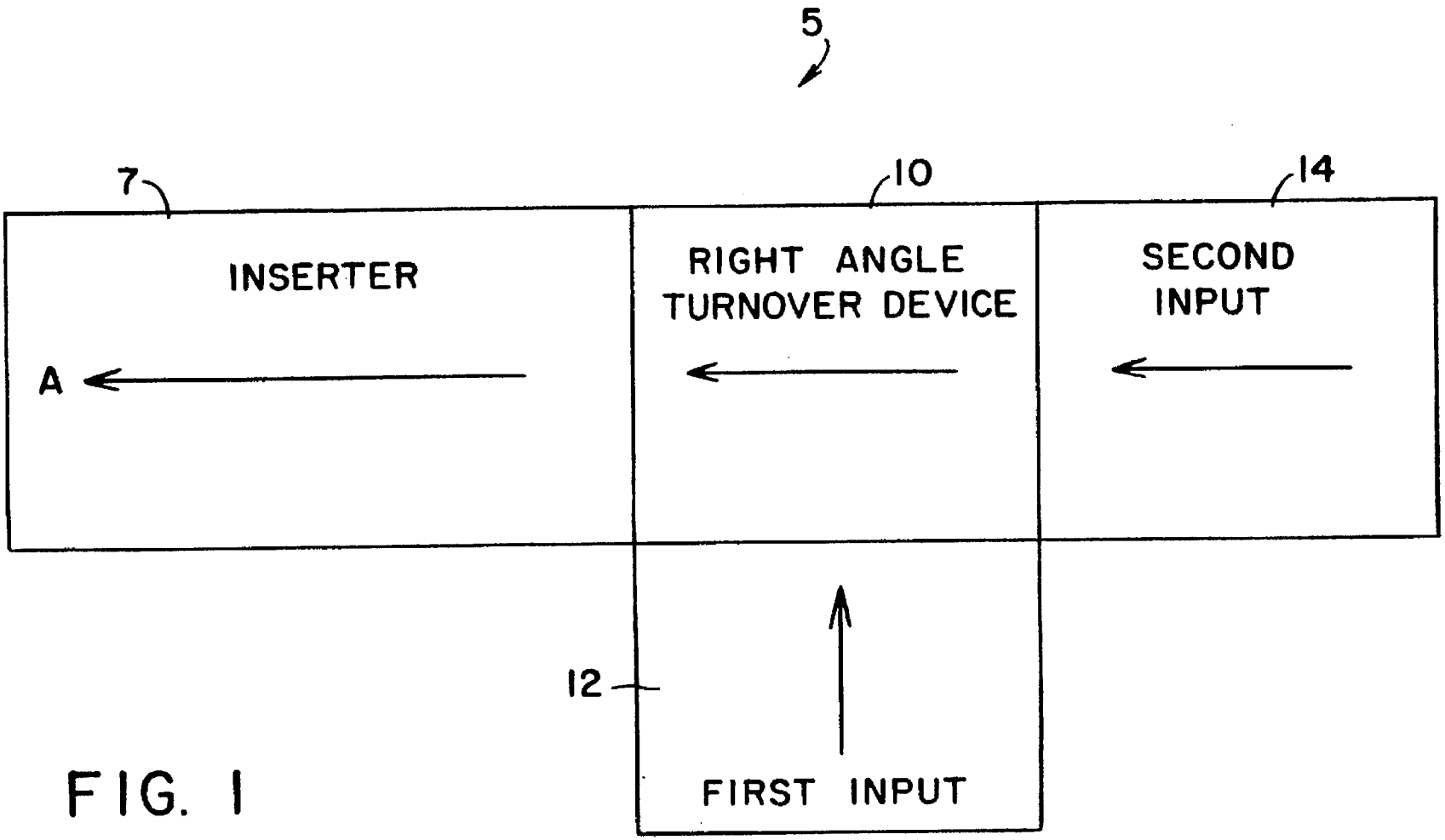
FIG. 1 is a block diagram of the right angle turn-over device of the present invention in an inserter system.
Figure 5:
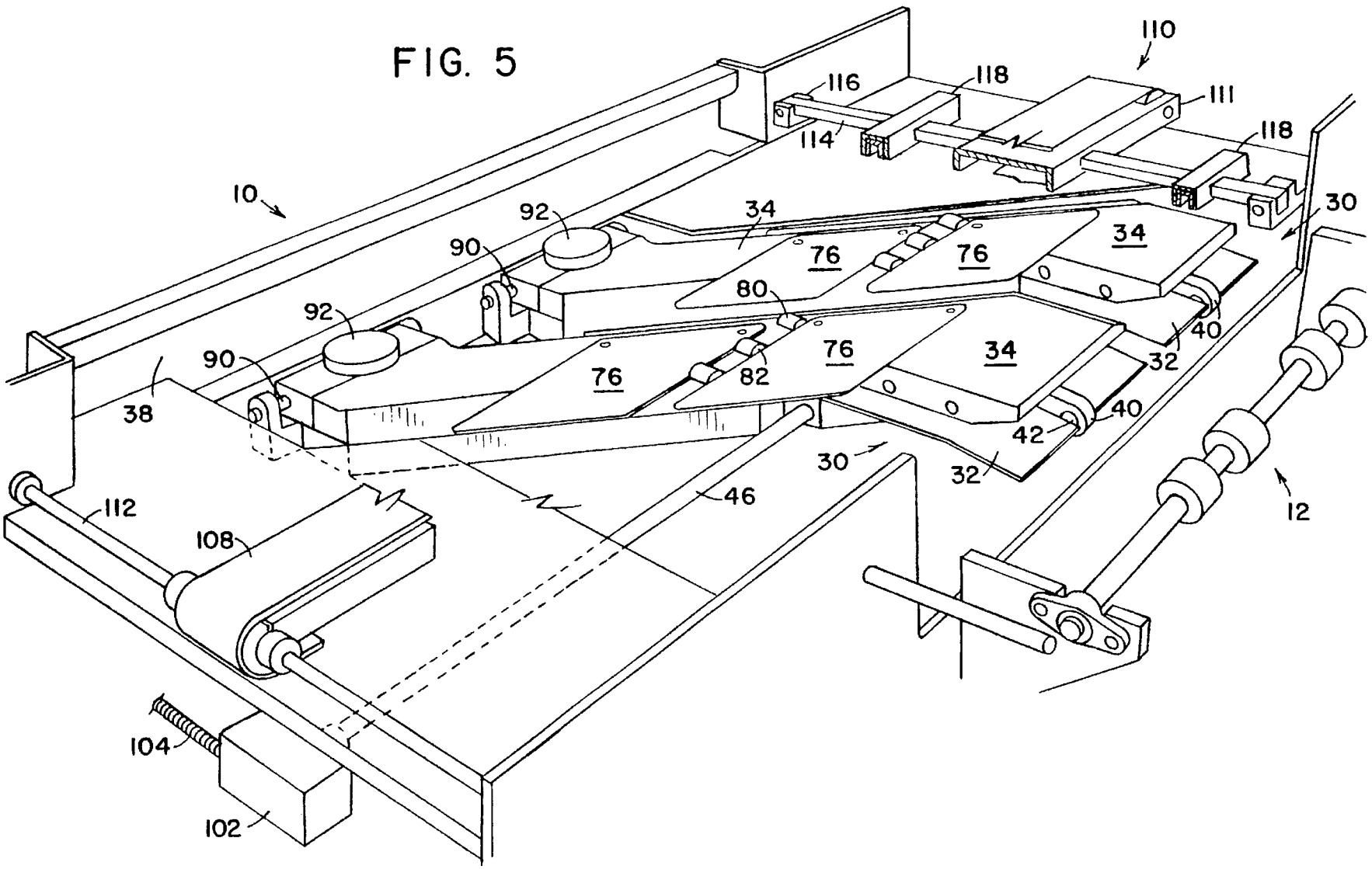
FIG. 5 is perspective view of the right angle turn-over device in accordance with the preferred embodiment of the present invention.

Referring now to FIG. 1, RAT 10 is part of an input section of a production mail system, generally designated 5, including an inserter 7, such as the Series 9000 Inserter that is manufactured by Pitney Bowes of Stamford Conn. RAT 10 receives documents fed seriatim from one or both of first and second input modules, 12 and 14 respectively. First input module 12 feeds documents in a direction orthogonal to the document path of inserter 16, shown as arrow A. Second input module 14 feeds documents in a direction identical to the inserter document path A.

As will be described in more detail below, RAT 10 can be configured to handle multiple forms that have been printed side by side, split and then fed by first input module 12. RAT 10 turns such split forms over and as they are turned over rotates them 90° to align them with document path A of inserter 7 (also referred to herein as the center line of the inserter). RAT 10 also merges the split forms in a desired order and with other documents or collations that may be conveyed from second input module 14.

Referring now to FIG. 2, an example is shown with sheets 1 & 2 printed side by side with printing on top. The sheets have been slit and cut to size, and are being fed from first input module 12 in a direction 90° to inserter 7. The sheets 1 and 2 are turned 90° as they are fed and are turned over so that the lead edge still leads but the printing is now on the bottom and sheet 2 is on top of sheet 1, and sheets 1 and 2 are in line with the center line of inserter 7.

In designing the present invention, alignment problems relating to the handling of different size documents had to be resolved. RAT 10 is adjustable to handle large and small documents such that the center line of the documents are aligned to the center line of inserter 7 after the right angle turn over. It will be understood by those skilled in the art that such alignment must be exact for each size document being processed or the document center lines will not match the center line of the inserter. Such center line alignment problems is most notable when handling the two extremes, i.e. largest and smallest of the document sizes.

Referring now to FIGS. 3 and 4, a basic embodiment of the present invention is seen. This embodiment provides a right angle turn over device, generally designated 20, including two sets of high friction belts located 90° to each other. One set comprises upper and lower input belts 22 and the other set comprises upper and lower output belts 24. As shown in FIG. 4, input belts 22 are at a lower elevation than output belts 24. The document path of output belts 24 is at the same elevation as the inserter deck (not shown). Between the sets of belts is a guide plate 26 that is rolled at 45° leading from input belts 22 and exiting at output belts 24.

For a two-up set of forms, i.e., two forms printed side by side on one sheet that is split into two documents (FIG. 2), two sets of right angle turn over devices 20 are needed. One device would be located in the input path of sheet 1, and the other in the input path of sheet 2. Both modules would be adjustable with respect to the inserter center line in order to align the turned sheets with the center line of the inserter.

Although the right angle turn over device 20 is suitable for the right angle turn over of a particular size document, the configuration of the input and output belts do not facilitate alignment adjustment for different size documents.

In accordance with the preferred embodiment of the present invention, RAT 10 is designed to handle a "three-up" configuration, i.e., three forms printed on a single sheet and then split into three separate forms that must be turned over at a right angle. Such a configuration requires that the first input module 12 handle smaller document sizes corresponding to the three split forms. It has been found that the right angle turn over modules of RAT 10 must be designed to be positioned close together to be able to process the three forms immediately after the slit is made.

Referring now to FIGS. 5–14, the preferred embodiment of the present invention is shown. RAT 10 is shown in a two-up configuration. In the following paragraphs a single right angle turn over module, generally referred to herein as a RAT module and designated 30, is described in detail followed by a description of the preferred embodiment of the RAT 10 device as part of the inserter system 5.

Each RAT module 30 includes an lower plate 32 having a 45° angled section and a turn over plate 34 having an identically angled section. Turn over plate 34 is pivotally mounted to the back end of lower plate 32, which is adjacent frame member 38 of RAT 10, and is cantilevered over lower plate 32. Since the support and mounting structure for turn over plate 34 is outside the document path, all support or mounting obstructions that are typically associated with a similar functioning device have been eliminated to significantly reduce document jams. Furthermore, the aforementioned structure provides access to the document path through RAT module 30 to facilitate jam clearance.

Lower plate 32 includes a lower input belt assembly that is adjacent the first input module 12. The lower input belt assembly includes an endless, flat lower input belt 40 that moves around an idler roller 42, which is adjacent the first input module 12, and a drive roller 44 which is driven by drive shaft 46. Between rollers 42 and 44 are a pair of spring loaded idler rollers 47 and 48. Idler rollers 42, 47 and 48 are rotatably mounted to shafts 50, 52 and 54, each of which have two sided flats at each end of the shaft. Shafts 50, 52 and 54 fit into slots (not shown) that are recessed in lower plate 32. It has been found that an easy method for spring loading idler rollers 47 and 48 is to place resilient material, such as a piece of o-ring belt in the slots before placing the shafts in the slots. Drive shaft 46 extends through the opening of drive roller 44 to drive lower input belt 40 in a conventional manner.

A 45° angled turning guide 60 is mounted to the top of the 45° angled section of lower plate 32 in a conventional manner, such as by screws (not shown). Turning guide 60 is a thin metal plate with one edge 62 curved up to guide documents around the 45° angled section of turn over plate 34. The length of turning guide 32 is at least the width of the largest document that can be processed by RAT 10.

Turn over plate 34 is approximately one inch thick and has a rounded edge 36 in the 45° angled section about which documents are turned over. Turn over plate 34 includes three rollers 66, 67 and 68 that are opposite input belt rollers 47, 48 and 44, respectively, when turn over plate 34 is locked in its operating position. The normal force of rollers 66, 67 and 68 against input belt rollers 47, 48 and 44 defines three nips in the input belt 40 for positive control of the incoming documents. The preferred spacing of the idler rollers is such that the smallest document to be processed is always in the control of at least two of the nips.

Turn over plate 34 includes a horizontal aperture 70 in the rounded 45° angled section 36. A sensor 72 is located in aperture 70 for sensing a document as it passes around turn over plate 34. An aperture 74 is located in a corresponding location in turning guide 60 such that apertures 70 and 74 are in line for sensing when turn over plate 34 is locked in its operating position.

Turn over plate 34 further includes three idler output rollers 80, 82 and 84 that are positioned at the top of turn over plate 34 in line with the center line of the document path of documents being turned over. Rollers 80, 82 and 84 are rotatably mounted to shafts 86, 87 and 88 which are mounted in the top of turn over plate 34. Rollers 80–84 provide normal force to an output belt 108 that is discussed in more detail below. A pair of deck plates 76 are mounted, one on each side of output idler rollers 80–84, to the top of turn over plate 34 to provide support to documents as they are turned over.

Figure 10:
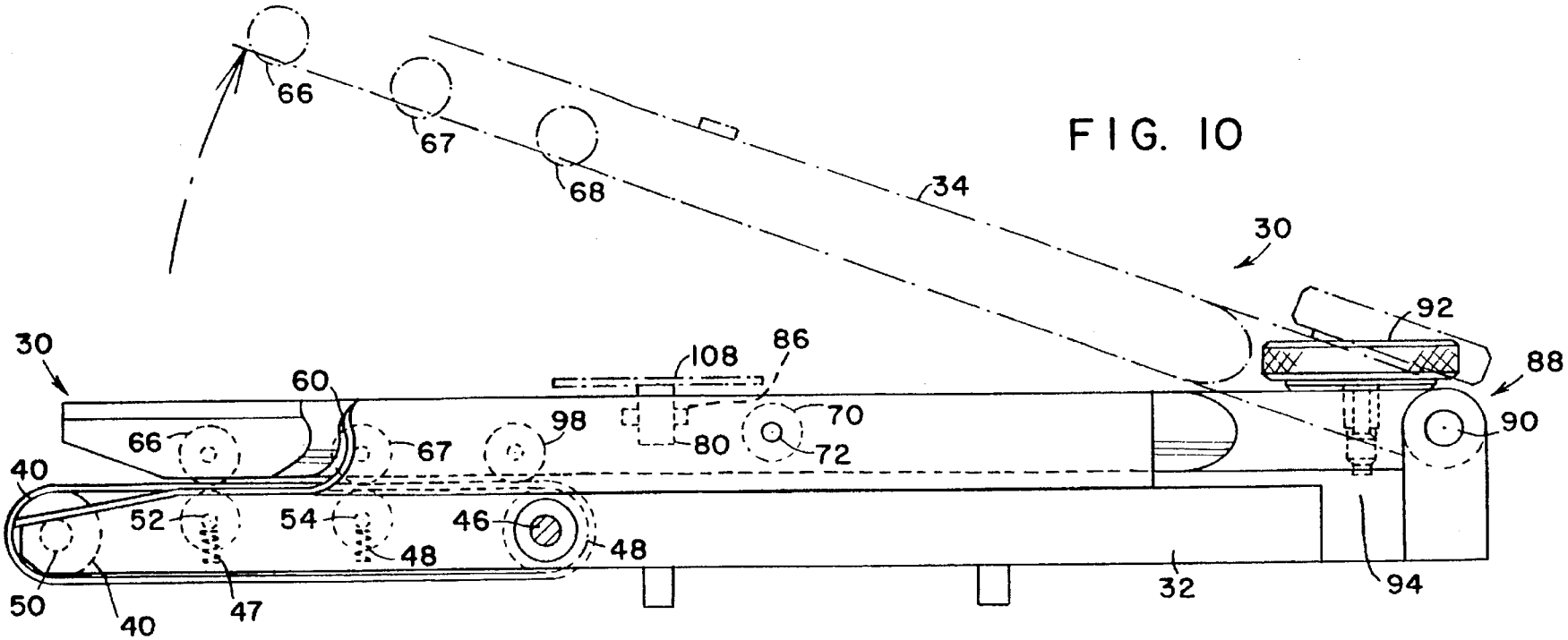
FIG. 10 is an end view of the right angle turn-over device seen in FIG. 4 with one of the right angle turn-over modules opened for jam clearance.
Figure 11:
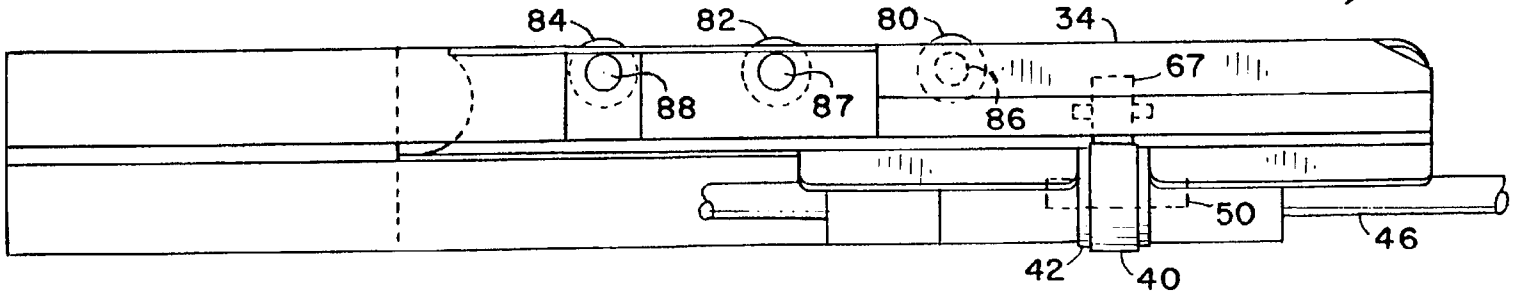
FIG. 11 is side view of the right angle turn-over device seen in FIG. 4 with the right angle turn-over modules in normal operating position.

RAT module 30 includes a jam clearing hinge, generally designated 88, by which turn over plate 34 is pivotally mounted to lower plate 32. Jam clearing hinge 88 includes a shaft 90 to which turn over plate 34 is slidably mounted and about which turn over plate 34 pivots for jam clearance (FIG. 10). Turn over plate 34 is locked into its operating position by a jam clearing release knob 92 which screws into a threaded block 94 in lower plate 32 to lock turn over plate 34 down for normal operation. When release knob 92 is removed from threaded block 94, turn over plate 34 must be moved approximately 9 mm away from turning guide 60 so that turn over plate 34 clears the curved edge 62 of turning guide 60 when being raised.

In the preferred embodiment of the present invention, turn over plate 34 made of nickel plated aluminum for durability and lower plate 32 is made of aluminum. Turning guide 60 and deck plates 76 are made of stainless steel.

Referring now to FIGS. 5–7 and 12–14, a description follows for a two-up RAT 10 device in inserter system 5. It will be understood that the following description applies as well to one-up or more than two-up RAT 10 devices.

RAT 10 includes two RAT modules 30 positioned adjacent one another a distance corresponding approximately to the width of the slit forms received from first input module 12. RAT modules 30 are slidably positioned along shaft 46 and are locked in place in a conventional manner. For example, lower plate 32 can be bolted directly to a frame member of RAT 10, or preferably, each RAT module 30 can be adjustably mounted on a position adjustment mechanism, such as a rack and pinion device, that would allow an operator to align the center line of each RAT module 30 to the center line of inserter 7, even while inserter system 5 is running. Shaft 46 is parallel to the center line (document path) of inserter 7 and is driven by a conventional 90° drive 102 (FIG. 6) which is preferably driven by a flexible drive shaft 104 so that shaft 46 and RAT modules 30 can positioned to align the output document path of RAT modules 30 to the center line of inserter 7.

There is an upper belt carriage assembly, generally designated 110, which extends at one end adjacent to second input module 14 to the other end adjacent inserter 7. Upper belt carriage assembly 110 includes an endless, flat upper output belt 108 that moves around an idler rollers 109 at the end which is adjacent the second input module 14, and drive rollers 107 which are driven by drive shaft 112. Rollers 107 and 109 are rotatably mounted within a belt carriage 111 that extends over the entire length of RAT 10 from second input module 14 to inserter 7. Between rollers 107 and 109 are three groups of pressure rollers 120, 122 and 124 which are described in more detail below. Upper belt carriage assembly 110 is suspended above the document path at one end by drive shaft 112 and at the other end by locking bar 114 which locks in place in a pair of locking bar detents 116. There are a pair of guide bars 118, one on each side of carriage assembly 110, extending parallel to carriage assembly 110. Guide bars 118 guide the outer edges of documents being processed by RAT 10. Guide bars 118 are adjustably positioned on and suspended above the document path by cross bar 117, which passes through upper belt carriage assembly 110, and by locking bar 114. Carriage assembly 110 is adjustably positioned along shaft 122 and locking bar 114 to align the center line of carriage assembly 110 to the center line of inserter 7 and idler output rollers 80, 82 and 84 of RAT modules 30, which are also aligned to the center line of inserter 7. Preferably, guide bars 118 are adjustably positioned a distance from the center line of carriage assembly 110 of just less than the width of the documents being processed.

Carriage assembly 110 includes three groups of three pressure rollers, generally designated 120, 122 and 124, that are adjustably mounted to carriage assembly 110. Each pressure roller 126 is suspended from carriage 111 by a leaf spring (not shown) to provide spring loaded normal force to the rollers. Each group of pressure rollers 120, 122 and 124 are contained in a carriage 130 that is slidably supported within slots 132 in carriage assembly 110. Each carriage 130 is positioned within carriage assembly 110 to match with the position of rollers 126 to the output rollers 80, 82 and 84 of the corresponding RAT module 30. There is a conventional locking mechanism 136, e.g., a thumb screw, that locks each carriage 130 in place after rollers 126 are positioned over the corresponding output rollers 80–84.

Figure 6:
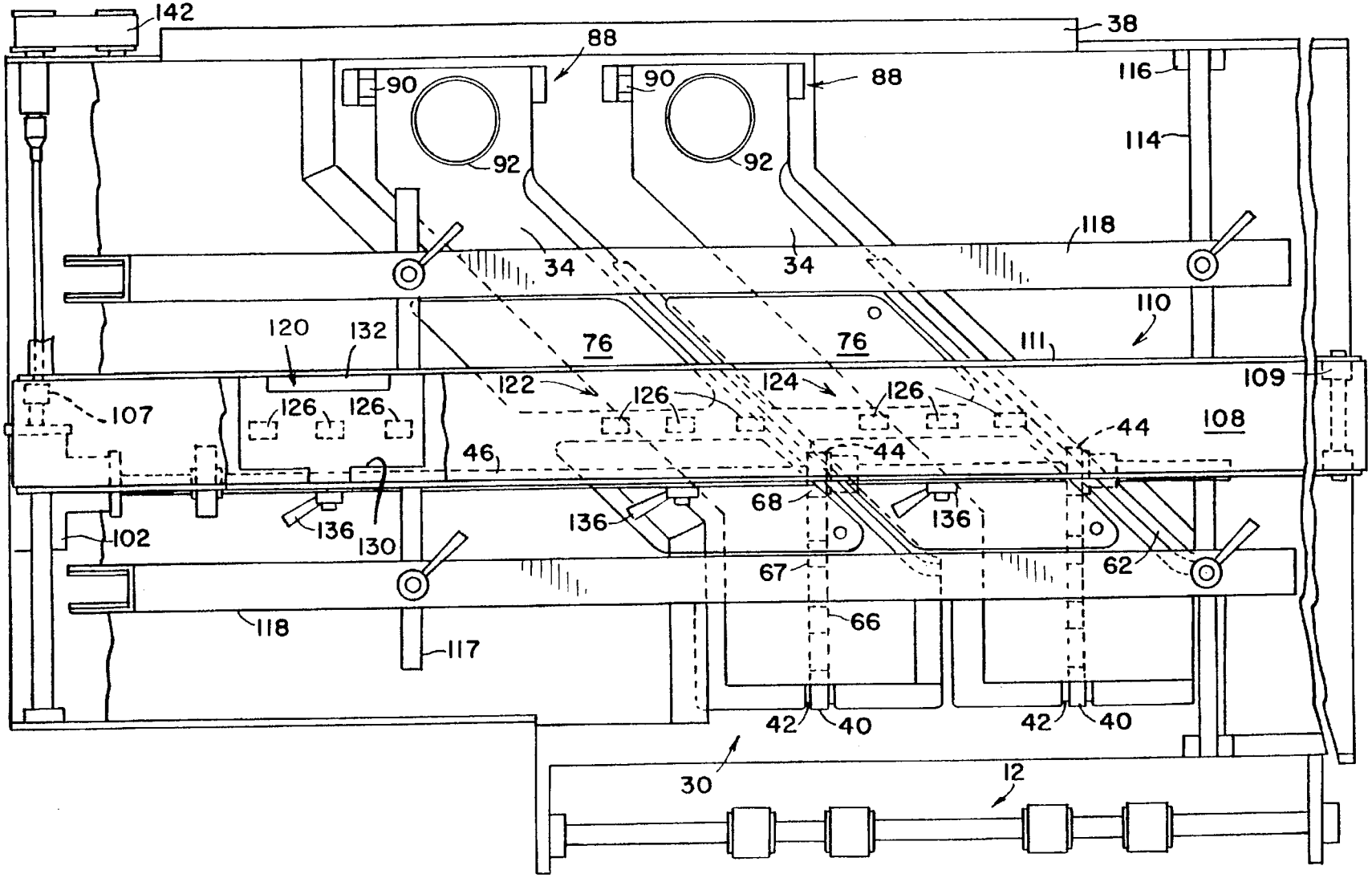
FIG. 6 is top view of the right angle turn-over device seen in FIG. 4.

Since the RAT 10 described herein is for a two-up configuration, only two RAT modules 30 are shown. The preferred embodiment of the present invention is suitable for adding a third RAT module 30 if necessary. In place of the missing third RAT module 30 is a "mimic" plate including three idler rollers (not shown) in place of the output rollers 80, 82 and 84 that would be present if the third RAT module 30 were installed. As shown in FIG. 6, the third carriage 130 of rollers 126 is above the location of the mimic output rollers.

Referring now to FIG. 7, a conventional serpentine belt drive, generally designated 140, is shown. Belt drive 140 drives shafts 46 and 112. Belt drive 140 includes motor 141, 90° drive 102, belt 142 and tension roller 144.

Since turn over plate 34 is separate from the turning guide 60, RAT 10 can turn over the slit documents immediately after they have been slit. There is no need to separate the slit documents. Generally, slit documents have to be separated before being turned over. Another benefit of the separation of turn over plate 34 from turning guide 60 is that turn over plate 34 can be separated from turning guide 60 (FIGS. 10 and 13) to provide access to documents jammed therebetween.

RAT 10 maintains positive control of each document from the time it enters a RAT module 30 to the time it exits RAT 10. The plurality of driven nips, as previously described, are close to each other, such that at least two nips have positive control of even the shortest document as the document passes through RAT 10. In particular, the last input nip (rollers 68 and 44) and the first output nip (rollers 126 and 80) maintain positive control of the document as it passes between turn over plate 34 and turning guide 60.

It was found that in order to get the proper alignment of the two output paper paths of the two RAT modules 30, the two RAT modules 30 had to be positioned in such a way that the left tip of the right input paper would hit turning guide 60 of the left RAT module 30. To avoid this problem, deflector plate 150 was mounted between the RAT modules 30 to relieve the right side of the turning guide 60 of the left RAT module 30. Deflector plate 150 deflects the left side of the right document under the turning guide 60 of the left RAT module 30.

Referring now to FIGS. 12 and 15–17, deflector plate 150 is mounted between RAT modules 30. In the preferred embodiment, deflector plate 150 is adjustably mounted to the top of the left RAT module 30 by screws extending through slots 154 in a bracket member 155 of deflector plate 150. Deflector plate 150 is angled at, it upstream end to guide downwardly the leading edge of the document to its right. In this manner, deflector plate 150 prevents the left RAT module 30 from interfering with the document path of the adjacent RAT module 30. Deflector plate 150 allows the two RAT modules 30 to be positioned closely for the handling of small documents. Thus, the present invention includes jam prevention as well as jam clearance features.

Yet another advantage of the present invention is that there are few moving parts in RAT 10. Each RAT module 30 in RAT 10 is a self contained module having self contained input belt and corresponding nip rollers that are driven by shaft 46 which is inserted through one of drive roller 48 during assembly of RAT 10. RAT module 30 is assembled with an assembly shaft which is replaced by shaft 46 during assembly of RAT 10.

The alignment of the outgoing documents is achieved by moving RAT modules 30 parallel to the inserter center line instead of in and out. The drive for input belt 40 on each RAT module 30 is driven by a single shaft 46. The torque is transmitted to drive roller 48 through a conventional one way clutch (not shown), allowing each RAT module 30 to be positioned anywhere along shaft 46. Output belt 108 is adjustably positioned over output rollers 80–84 in RAT modules 30. The normal force for output belt 108 is achieved by rollers 126 mounted on each carriage 111.

For jam clearance upper belt carriage assembly 110 and guide bars 118 are raised by removing locking bar 114 from detents 116. If the jam is in one of the RAT modules 30, then the turn over plate 34 must be raised for the RAT module 30 having the jam. The turn over plate 34 is raised by unscrewing release knob 92, sliding the turn over plate 34 away from turning guide 60 and then lifting turn over plate 34 to access the input path of RAT module 30 and turning guide 60.

Figure 12:
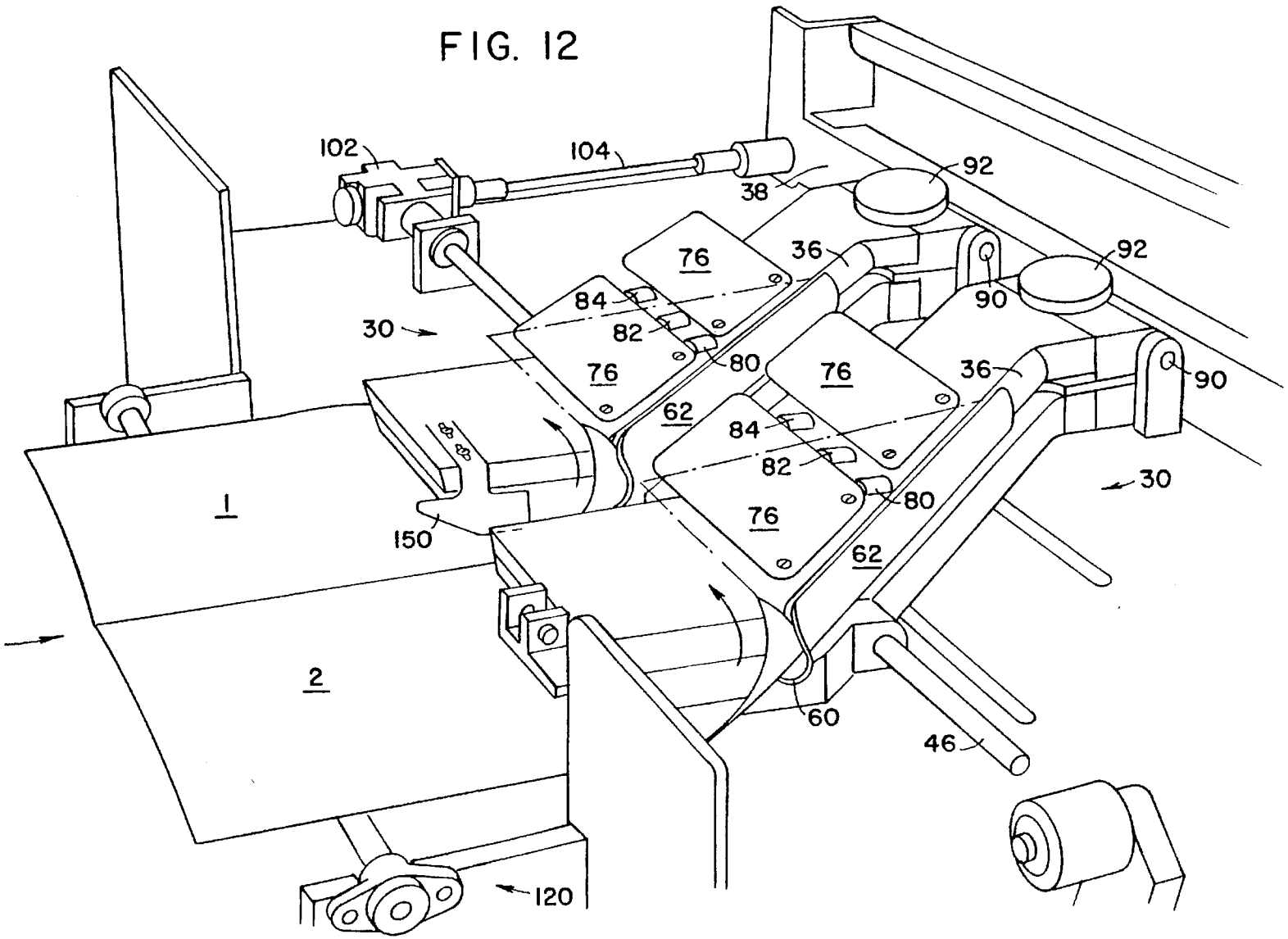
FIG. 12 is a perspective view of the of the right angle turn-over device seen in FIG. 4 with some of the structure removed to show the right angle turn-over of the sheets.
Figure 13:
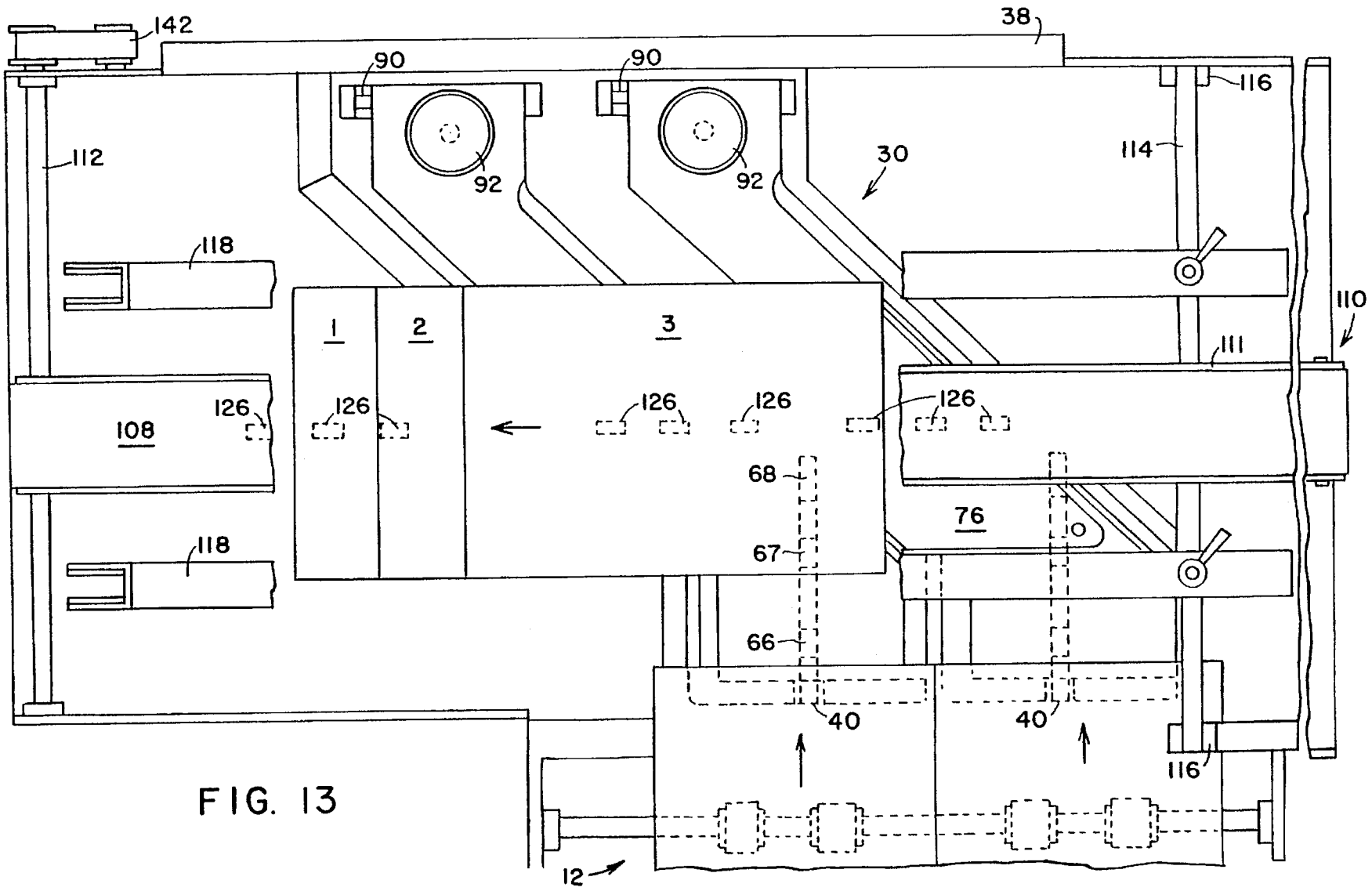
FIG. 13 is a top view of the of the right angle turn-over device seen in FIG. 4 showing a sheet fed from a second input.
Figure 14:
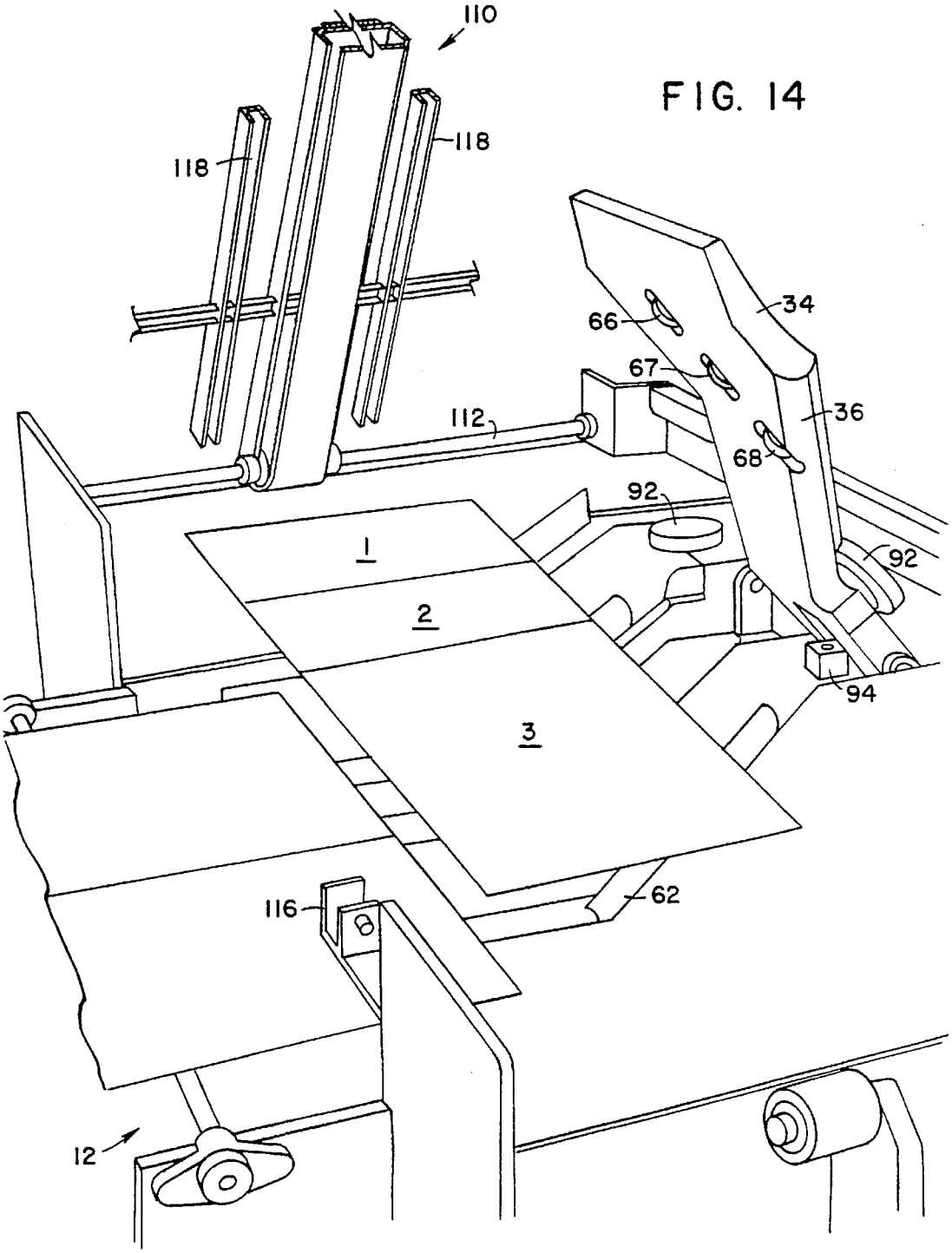
FIG. 14 is a perspective view of the right angle turn-over device seen in FIG. 4 with an upper belt carriage and one of the right angle turn-over modules raised.
Figure 15:
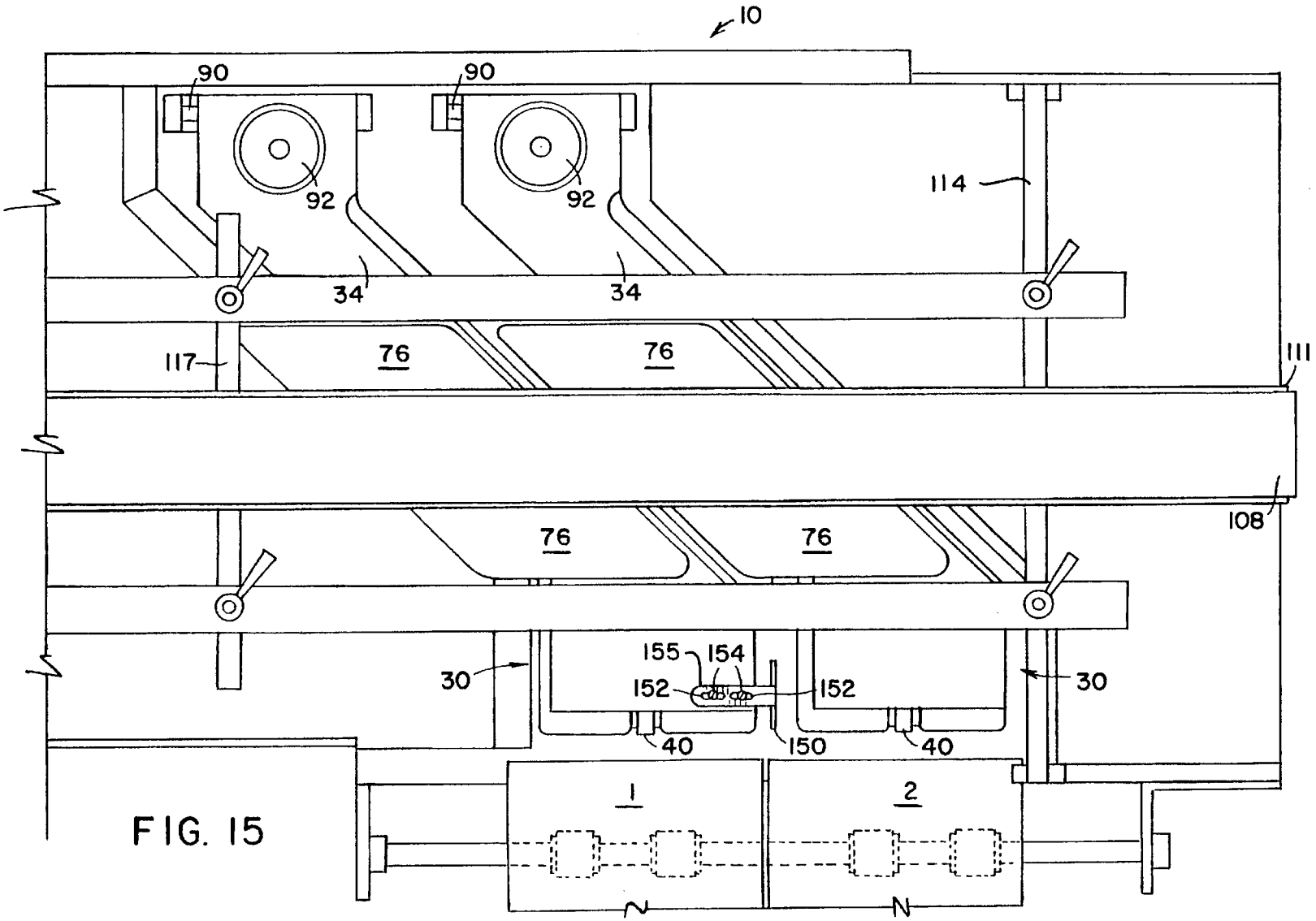
FIG. 15 is a partial top view of the right angle turn over device with a deflector plate added between the right angle turn over modules.

Referring now to FIG. 15, two documents 1 and 2 that have been previously slit from one sheet (not shown) are fed to adjacent RAT modules 30 that have been positioned in RAT 10 such that after documents 1 and 2 move through the respective RAT modules 30, the center line of the documents 1 and 2 are in alignment with the center line of inserter 7 (FIG. 1). FIG. 12 shows documents 1 and two being guided by the respective guiding plates 60 around turn over plate 34. FIGS. 13 and 14 show documents 1 and 2 turned over with document 2 above document 1 and the center lines the documents are aligned. Also shown is a document 3 that has been fed on top of document 2 from second input 14 with the same center line alignment. It will be understood that if desired documents 1, 2 and 3 can be lead-edge registered upstream from RAT 10.

Figure 18:
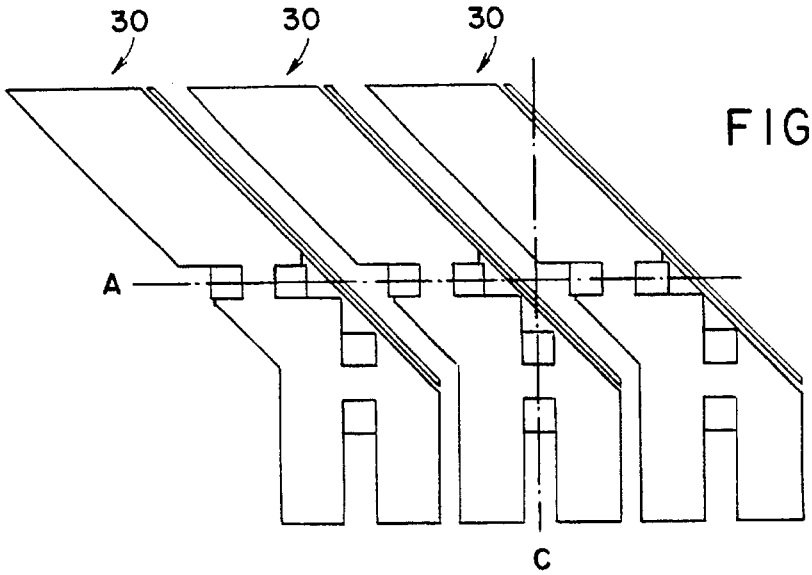
FIG. 18 is a top view of a three-up configuration of the right angle turn-over modules.

Referring now to FIG. 18, a three-up configuration of RAT modules 30 is shown for the processing of 3 side by side documents that have been slit from a larger sheet (not shown). Line C is the center line of the larger sheet. Line A is the center line of the output path of RAT modules 30.

Figure 19:
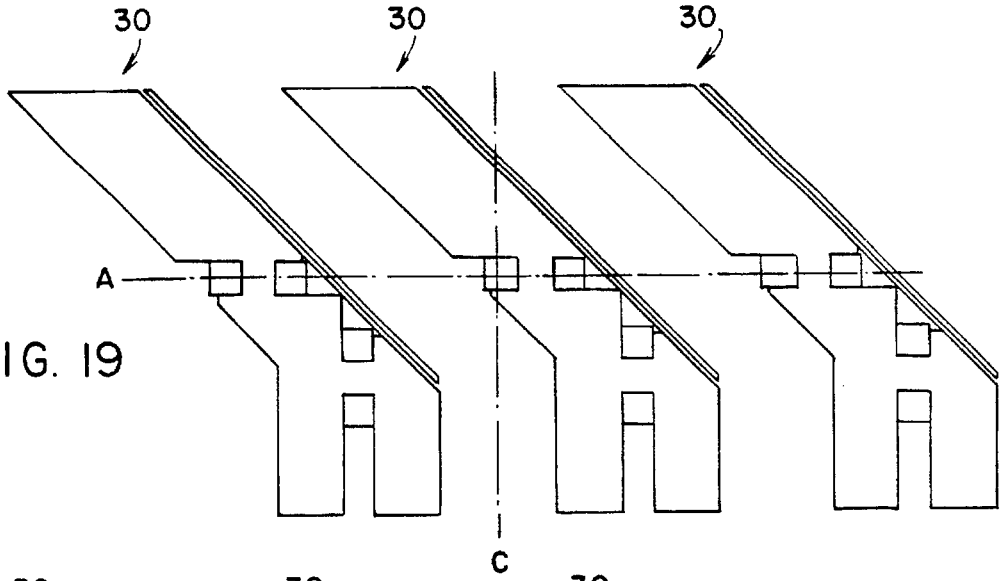
FIG. 19 is a top view of a two-up configuration of the right angle turn-over modules.

Referring now to FIG. 19, a two-up configuration of RAT modules 30 is shown for the processing of 2 side by side documents that have been slit from a larger sheet (not shown). Line C is the center line of the larger sheet. It can be seen that the RAT module 30 on the right is in a non-functioning position with regard to the turn over function but is still functional with regard to output path A.

Figure 20:
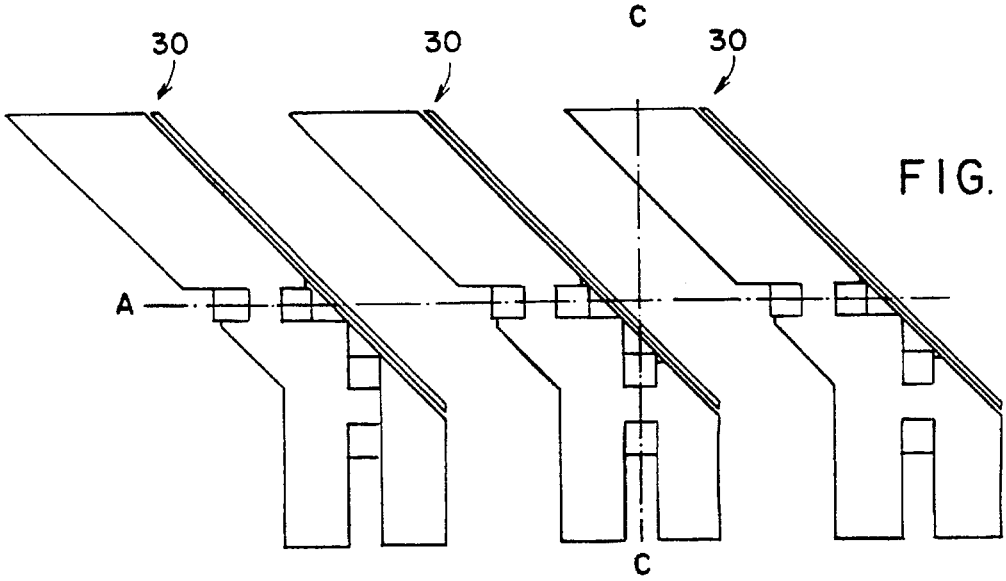
FIG. 20 is a top view of a one-up configuration of the right angle turn-over modules.

Referring now to FIG. 20, a one-up configuration of RAT modules 30 is shown for the processing of a single document. Line C is the center line of the document. It can be seen that the right and left RAT modules 30 are in non-functioning positions with regard to the turn over function but are still functional with regard to output path A.

It will be understood that in an alternate embodiment (not shown) output path A could be below the input path from first input 12. In this embodiment sheets would be turned down instead of up as in the preferred embodiment.

While the present invention has been disclosed and described with reference to a single embodiment thereof, it will be apparent, as noted above that variations and modifications may be made therein. It is also noted that the present invention is independent of the machine being controlled, and is not limited to the control of inserting machines. It is, thus, intended in the following claims to cover each variation and modification that falls within the true spirit and scope of the present invention.

What is claimed is:

1. Apparatus for receiving multiple first documents cut from a single sheet that are being fed side by side in a first direction and individually guiding and controlling the first documents through a right angle turn, comprising:

input means for simultaneously receiving the first documents being conveyed side by side in a first direction along a first deck level and transporting the side by side first documents in said first direction;

means adjacent said input means for simultaneously turning over the side by side first documents to a second direction that is orthogonal to said first direction wherein said first documents are in a shingle relationship after being turned over;

output means adjacent said turning over means for transporting the first documents along a second deck level in the second direction; and wherein said input means transports the first documents through said turning over means to said output means, said input means including a plurality of lower endless belts, each of said lower belts having an upper reach moving in said first direction, and means for applying a normal force against said upper reach of each said lower endless belt, and wherein said output means further include idler output rollers at said second deck level and an upper endless belt suspended above said second deck level, said upper endless belt having a lower reach moving in said second direction, and means for applying a normal force against said lower reach of said upper endless belt toward said idler output rollers.

2. The apparatus of claim 1 wherein said output means includes means for receiving second documents being conveyed seriatim along said second deck level in said second direction and transporting said second documents in said second direction, said output means having an input end on said second deck level separate from said turning over means.

3. The apparatus of claim 1 further including a motor coupled to a drive assembly for driving each of said input and output means.

4. The apparatus of claim 1 wherein said first deck level is below said second deck level.

5. The apparatus of claim 1 further comprising an upper belt carriage assembly supporting said upper endless belt, said upper belt carriage assembly having upstream and downstream ends and being pivotally coupled at one of said upstream and downstream ends to side frame members and removably coupled at the other end, whereby said upper belt carriage assembly can be pivoted away from said idler output rollers.

6. Apparatus for receiving multiple first documents cut from a single sheet that are being fed side by side in a first direction and individually guiding and controlling the first documents through a right angle turn, comprising:

a plurality of right angle turn over modules each comprising:

a lower plate having input means at one end for receiving a first document conveyed thereto in a first direction along a first deck level;

an upper plate mounted a fixed distance above said lower plate, said upper plate including a turn over section adjacent to a downstream end of said input means, said turn over section angled at 45° to the first direction, said upper plate further including means superposed over said input means for cooperating with said input means for transporting the first document through said turn over section, said upper plate also including a plurality of output rollers rotatably mounted in the top of said upper plate and oriented for moving the first document in a second direction that is orthogonal to said first direction; and a turning guide positioned adjacent said turn over section, said turning guide including an upwardly curved edge that extends a fixed distance from the turn over section for guiding the first document around said turn over section;

means for driving said input means;

a belt assembly positioned above said upper plate of each of said right angle turn over modules and oriented for conveying the first documents in said second direction, said belt assembly including an endless upper belt moving around at least two rollers and further including means for applying a normal force to the lower reach of said upper belt directly above each of said output rollers whereby said upper belt and said output rollers cooperate to convey the first documents out of each of said turn over sections of said upper plates;

means for driving said upper belt; and deflector means located between said input means of first and second ones of said right angle turn over modules that are adjacent to each other, for deflecting one of the first documents whereby said one of the first documents being fed into said input means of the first one of said right angle turn over modules avoids being conveyed into any part of the second one of said right angle turn over modules into which an adjacent first document is being fed.

7. The apparatus of claim 6 wherein said belt assembly includes means for receiving second documents being conveyed seriatim along a second deck level in said second direction and transporting said second documents in said second direction, said belt assembly having an input end on said second deck level separate from said right angle turn over modules.

8. The apparatus of claim 6 wherein said input means includes an input belt moving around at least two input rollers that are rotatably mounted within said lower plate, said input belt having an upper reach defining a first path.

9. The apparatus of claim 8 wherein said input means further includes at least one spring loaded roller located between said input rollers, said spring loaded roller applying a normal force to the upper reach of said input belt.

10. The apparatus of claim 6 further comprising hinge means for pivotally mounting a mounting end of said upper plate to an end of said lower plate opposite said input means, said lower plate including a support block adjacent said hinge means on which said upper plate rests whereby said upper plate is cantilevered over said lower plate.

11. The apparatus of claim 10 wherein said hinge means includes a pivot shaft mounted in said lower plate transversely to said first direction, said upper plate including a corresponding transverse aperture extending the entire width of the mounting end of said upper plate through which said pivot shaft extends, said pivot shaft having a length greater than the width of said mounting end.

12. The apparatus of claim 11 wherein said upper plate is in a normal operating position at one end of said pivot shaft with said turn over section a fixed distance from said curved edge of said turning guide.

13. The apparatus of claim 12 further comprising means for locking said upper plate in said operating position.

14. The apparatus of claim 12 wherein said upper plate is at a non-operating position when moved to the other end of said pivot shaft, said non-operating position providing clearance for said turn over section from said turning guide thereby allowing said upper plate to pivot up from said lower plate.

15. The apparatus of claim 12, wherein said input means includes a spring loaded roller, and said upper plate further includes at least one idler roller rotatably mounted in the bottom of said upper plate at a location directly above said spring loaded roller of said input means when said upper plate is in said normal operating position.

16. The apparatus of claim 6, wherein said plurality of idler output rollers mounted in the top of said upper plate, are idler output rollers oriented in a direction orthogonal to said first direction.

17. The apparatus of claim 16, wherein said upper plate further includes pair of deck plate mounted on each side of said idler output rollers.

18. The apparatus of claim 6 further comprising means for adjusting the position of said right angle turn over modules whereby the first documents are in a desired alignment as the first documents are transported around respective turn over sections to a document path in said second direction.

19. The apparatus of claim 6 wherein said belt assembly comprises upstream and downstream ends, said belt assembly being pivotally coupled at one of said upstream and downstream ends to side frame members and removably coupled at the other end, whereby said belt assembly can be pivoted away from said output rollers.

* * * * *